US006484643B1

(12) United States Patent
Hilgert

(10) Patent No.: US 6,484,643 B1
(45) Date of Patent: Nov. 26, 2002

(54) FIXED BUMPING POST

(76) Inventor: Eike Hilgert, Moselstrasse 11, 49565 Bramsche (DE)

( * ) Notice: Subject to any disclaimer, the term of this patent is extended or adjusted under 35 U.S.C. 154(b) by 0 days.

(21) Appl. No.: 10/053,518

(22) Filed: Oct. 23, 2001

(51) Int. Cl.[7] ..... B61K 7/00
(52) U.S. Cl. ..... 104/254; 104/249
(58) Field of Search ..... 104/249, 254, 104/256, 257, 258, 259, 260; 403/409.1; 188/38, 41, 62, 63

(56) References Cited

U.S. PATENT DOCUMENTS 1,195,889 A * 8/1916 Willeford ..... 403/409.1
1,204,189 A * 11/1916 Rawie ..... 104/254
5,836,252 A 11/1998 Roick
5,865,122 A 2/1999 Hudson et al.
6,237,726 B1 5/2001 Roick

FOREIGN PATENT DOCUMENTS

CA 808.405 1/1979
CA 408.399 9/1980

* cited by examiner

*Primary Examiner*—Mark T. Le
(74) *Attorney, Agent, or Firm*—Weiner & Burt, P.C.; Irving M. Weiner; Pamela S. Burt

(57) ABSTRACT

A railroad bumping post with coupling mechanisms which form a box about each rail and permit wedging of the rail within the box to secure the bumping post to the rails.

10 Claims, 6 Drawing Sheets

FIXED BUMPING POST

SCOPE OF THE INVENTION

The present invention relates to a railroad bumping post and, in particular, to a fixed bumping post for use in coupling railroad cars.

BACKGROUND OF THE INVENTION

Bumping posts for use on railroad tracks are known. Such bumping posts include bumping posts useful for coupling railroad vehicles. With such coupling bumping posts, railroad cars are intentionally driven into the bumping posts so as to engage mechanical coupling mechanisms between the cars. Such coupling bumper posts are provided in railroad yards where various railroad cars are to be coupled into a train. To couple a new car or grouping of cars to an existing train, an engine will sandwich the new car or cars between the existing train and the coupling bumper posts to compress the train and new cars together and ensure coupling of mechanical coupling devices between the existing train and the new cars. Typically, in assembling a train, the engine will bump cars into the coupling bumping post numerous times. Preferably, the trains are controlled to engage the coupling bumping posts with as small as possible force as is necessary to ensure coupling between the cars. However, even when care is taken in operating the trains, with time and repeated impacts, the bumping posts or the rails on which they are coupled are subject to mechanical failure. As well, due to operator error, a train will, from time to time, impact the coupling bumper posts with excessive force and thereby cause immediate mechanical failure.

Coupling bumper posts have to be replaced periodically and when they may fail, need to be replaced promptly to permit continued operation of the railroad yard. Previously known coupling bumper posts suffer the disadvantage that they cannot easily and speedily be removed and installed.

Aside from coupling bumper posts, other bumping posts are well known which are provided for safety, that is, to stop runaway trains and the like. Many such safety bumper posts are known which are adapted to move along the rails so as to provide resistance. Such safety bumper posts which slide along the rails are designed to dissipate over time and distance the very substantial forces required to stop a moving train. Such safety bumping posts are designed to stop trains of varying weights and travelling at varying speeds. Such safety bumper posts typically have shoes or other mechanisms which are to engage the rail and with increased longitudinal sliding along the rails gradually increase the resistance to movement.

Known safety bumping posts typically have relatively complex construction with the result that the safety bumping posts are relatively expensive and would not be economically feasible for use as coupling bumping posts.

SUMMARY OF THE INVENTION

To at least partially overcome these disadvantages of previously known devices, the present invention provides a railroad bumping post with coupling mechanisms which form a box about each rail and permit wedging of the rail within the box to secure the bumping post to the rails. Preferably, the coupling mechanisms have removable laterally slidable components to form the box about a rail which slidable components are added after the bumping post has been placed on the rails. Preferably, the coupling mechanism with the slidable components removed form feet to receive the rails and support the bumping post stabily on the rails while the slidable components are applied.

An object of the present invention is to provide a bumping post which can easily be coupled and uncoupled to railroad rails.

Another object is to provide a bumping post which has feet to be safely self supporting on railroad rails prior to being clamped thereto.

Accordingly, in one aspect, the present invention provides a bumping post assembly for securing to rails of a railroad tack, the assembly having a frame supporting a bumper member positioned for engagement by a railroad vehicle on the rails, a box-forming coupling foot for coupling the frame to a railroad rail, the foot comprising a top member and two laterally spaced side members, the side members extending downwardly from the top member to define a channelway under the top member and between the side members opening downwardly and adapted to receive a rail under the top member with one side member on each side of the rail and each side member extending downwardly beyond the rail, a removable bottom member extending under the rail from one side member to the other side member and coupled to each of the side members to limit relative movement of the bottom member downwardly away from the top member, the bottom member removably coupled to the side members for removal by movement in a generally horizontal direction, a wedge member for wedging insertion between the top member and a rail received thereunder to wedge the rail vertically between the top member and the bottom member when the bottom member extends under the rail between the side members to enclose the channelway.

BRIEF DESCRIPTION OF THE DRAWINGS

Further aspects and advantages of the present invention will become apparent from the following description of the drawings in which.

DETAILED DESCRIPTION OF THE DRAWINGS

Figure 1:
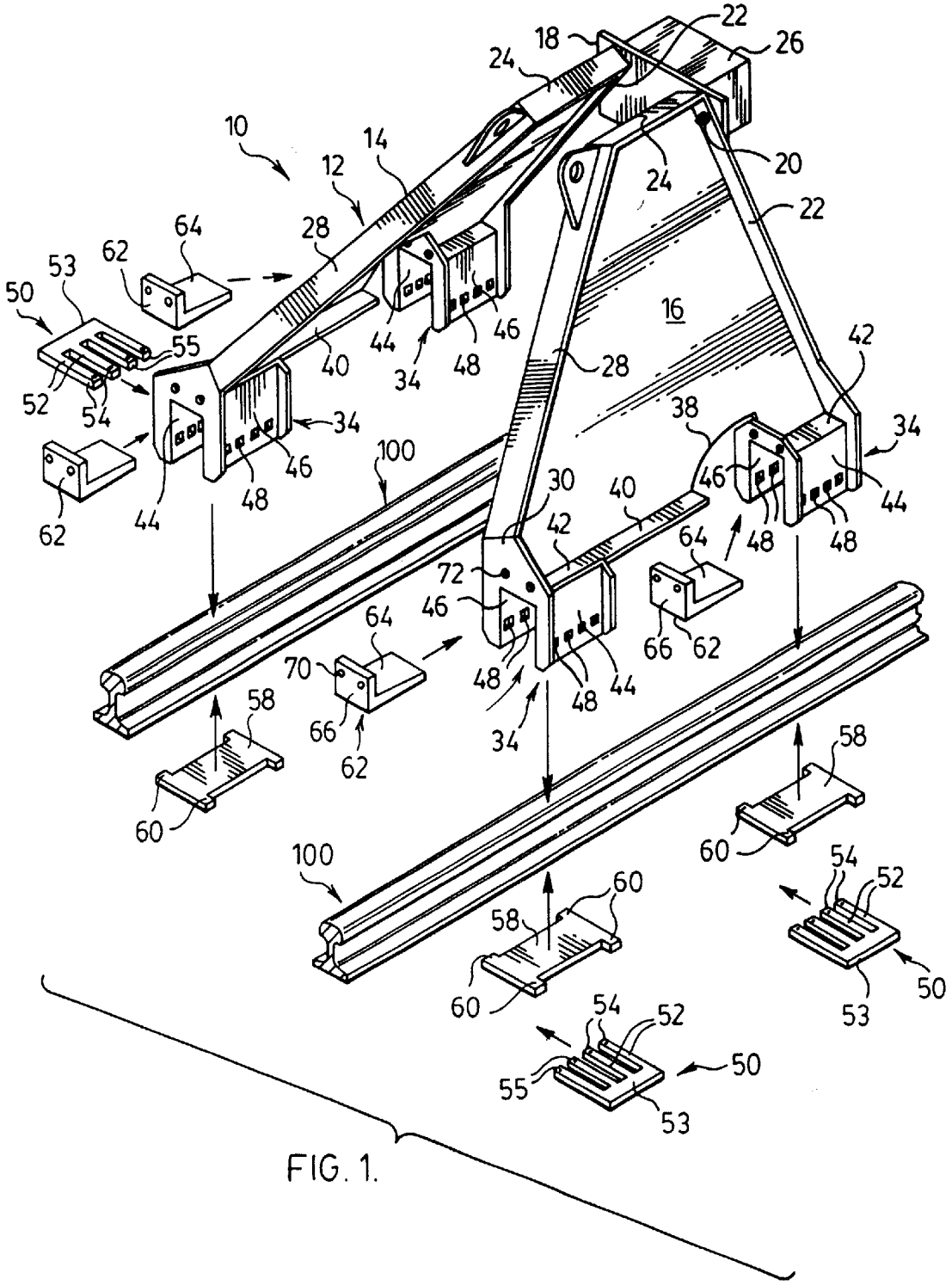
FIG. 1 is an exploded pictorial view of a preferred first embodiment of a bumping post in accordance with the present invention.

Reference is made to FIG. 1 which shows an exploded view of a bumping post 10 in accordance with the present invention which is adapted to be mounted onto a pair of rails 100. The bumping post has a frame with two slanted side wall members 14 and 16 which are joined together by being fixedly fastened to a front wall member 18 as by bolts and nuts 20. The frame carries four coupling mechanisms 34 for coupling to the rails 100 respectively at the front and rear bottom ends of each of the wall members 16 and 18. Each of the coupling assemblies 34 are substantially identical and similar reference numerals are used to refer to similar elements.

Figure 4:
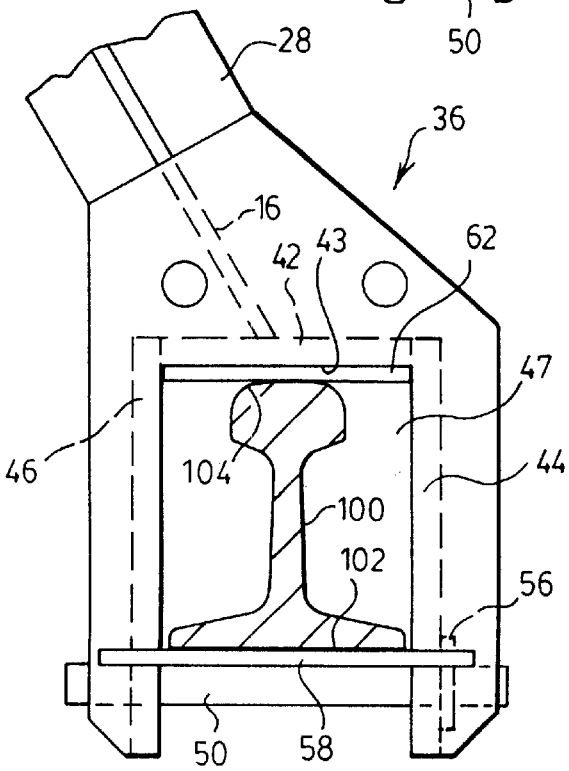
FIG. 4 is an enlarged rear end view of the right hand coupling assembly shown in FIG. 3.
Figure 5:
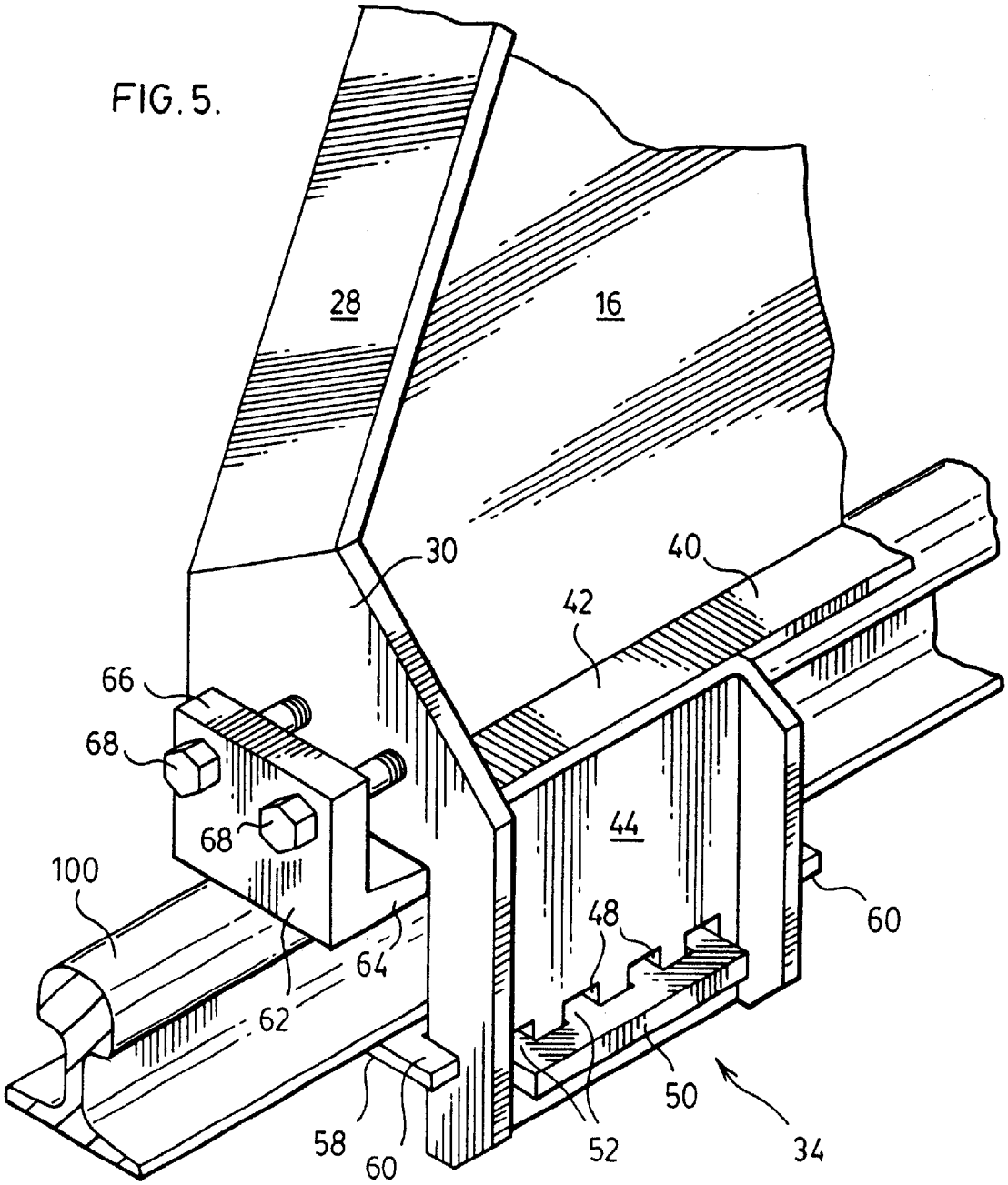
FIG. 5 is an enlarged pictorial view of the right hand rear coupling assembly of FIG. 1 shown clamped onto a rail.

Each coupling mechanism 34 comprises a top plate 42, an outer side plate 44 and an inner side plate 46. Each of the side plates 44 and 46 are vertical plates which are fixedly secured to and extend vertically downwardly from the horizontal top plate 42. The top plate 42 and two side plates 44 and 46 form a downwardly opening channelway 47 adapted to receive one of the rails 100 therein as seen, for example, in FIG. 4. The channelway 47 extends longitudinally parallel the length of a rail. The channelway 47 has a width wider than the width of a rail as seen in FIG. 4 and a vertical depth which is greater than the height of the rail in the sense that the two side plates 44 and 46 extend vertically downward beyond the bottom 102 of the rail 100.

Figure 6:
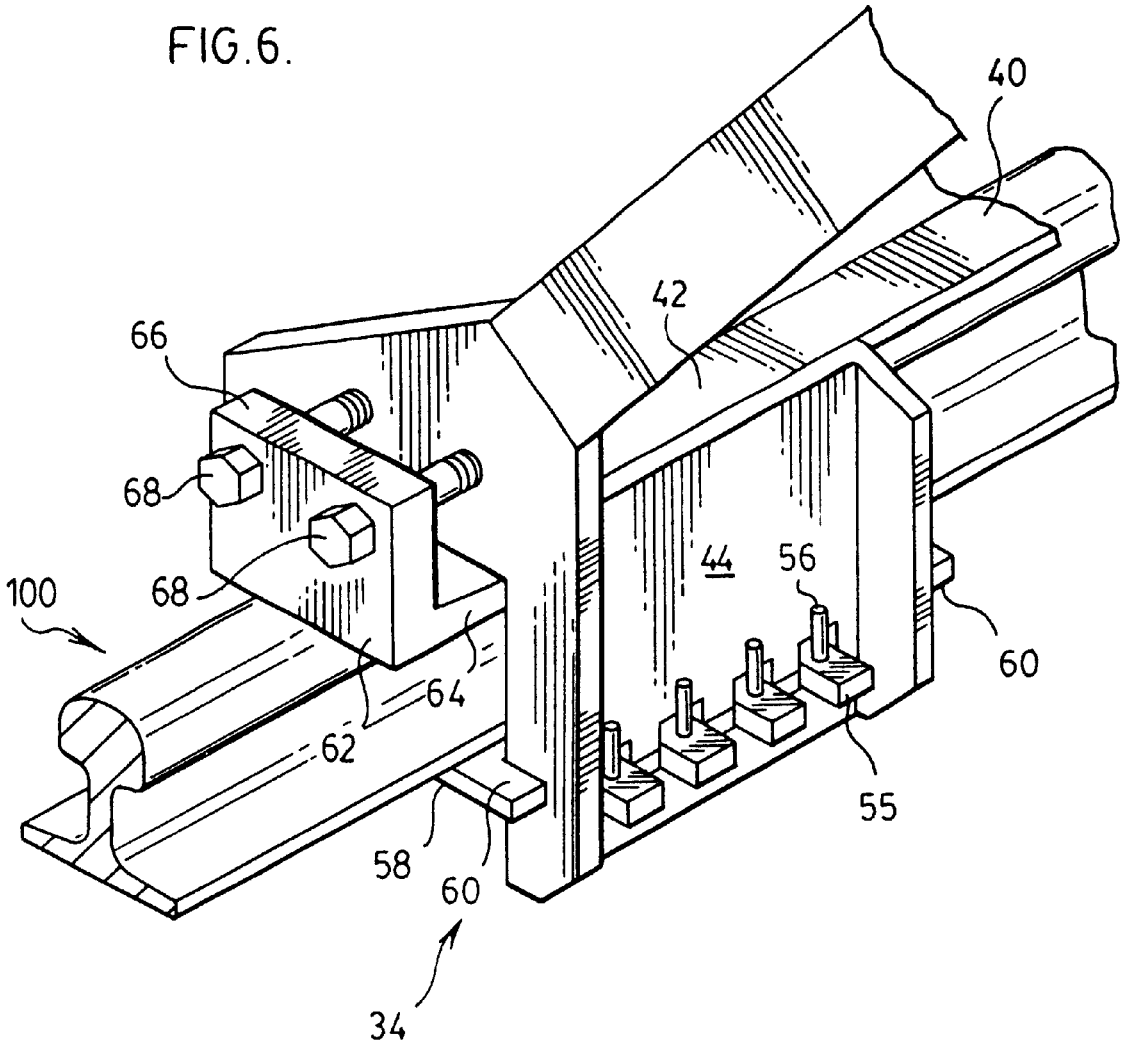
FIG. 6 is an enlarged pictorial view similar to that of FIG. 5 but of the left hand rear coupling assembly of FIG. 1.

Each coupling mechanism 34 further includes a removable bottom plate 50 and a removable wedge member 62. Each of the side plates 44 and 46 is provided with an array of horizontally extending openings 48. The bottom plate 50 has a generally comb-like configuration with four fingers 52 extending from a spline-like portion 53 to their distal ends 55. The bottom plate 50 is adapted to have its fingers 52 slide horizontally through the openings 48 in one side plate and to pass through the openings 48 in the other side plate. Each of the fingers 52 have proximate their distal ends 55 vertical openings 54 which are adapted to receive lock pin members 56 as best shown in FIGS. 4 and 6 so as to secure the bottom plate 50 to the side plates 44 and 46 against removal. With the bottom plate 50 inserted so as to bridge between the two side plates 46 and 50, the bottom plate 50 closes the channelway 47. Together with the top plate 42, two side plates 44 and 46, the bottom plate 50 forms a box-like structure completely encircling the rail 100. The bottom rail 50 is secured to the side plates 44 and 46 in a manner which limits the ability of the top plate 42 and bottom plate 50 to move vertically away from each other.

The wedge member 62 is best shown by itself in FIG. 1. The wedge member is adapted to slide longitudinally into one end of the channelway in between the lower surface 43 of the top plate 42 and the upper surface 104 of the rail 100. The wedge member 62 has a horizontal wedge portion 64 and a vertical support portion 66. The wedge portion 64 is adapted to be wedged in between the top plate 42 and the top of the rail 100. With the wedge portion 64 tapering to increase in width towards its vertical support section 66, as the wedge member 62 is driven longitudinally of the rail 100 into the channelway 47, the wedge will tend to wedge the rail and lock it in place jammed vertically in between the top plate 42 and the bottom plate 50.

A spacing or shim plate 58 is shown in the Figures as to provide in the channelway 47 above the bottom plate 50. The shim plate 58 has a general H-shape by reason of projections 60 being provided at each of its ends such that the shim plate may slide vertically within the channelway 47, however, once located therein will be prevented from longitudinal movement out of the channelway by reason of the projections 60 extending laterally beyond the side plates 44 and 46. A plurality of different sized shim plates 58 can be provided to assist in coupling to rails 100 which may be of different heights.

It is to be appreciated that the wedge member 62 is to be forced axially into the channelway between the top plate 42 and the top of the rail 100. By urging the wedge into the channelway, the vertical height between the top plate 42 and the bottom plate 50 becomes assumed by any shim plate 58, the rail 100 and the wedge 64.

Figure 2:
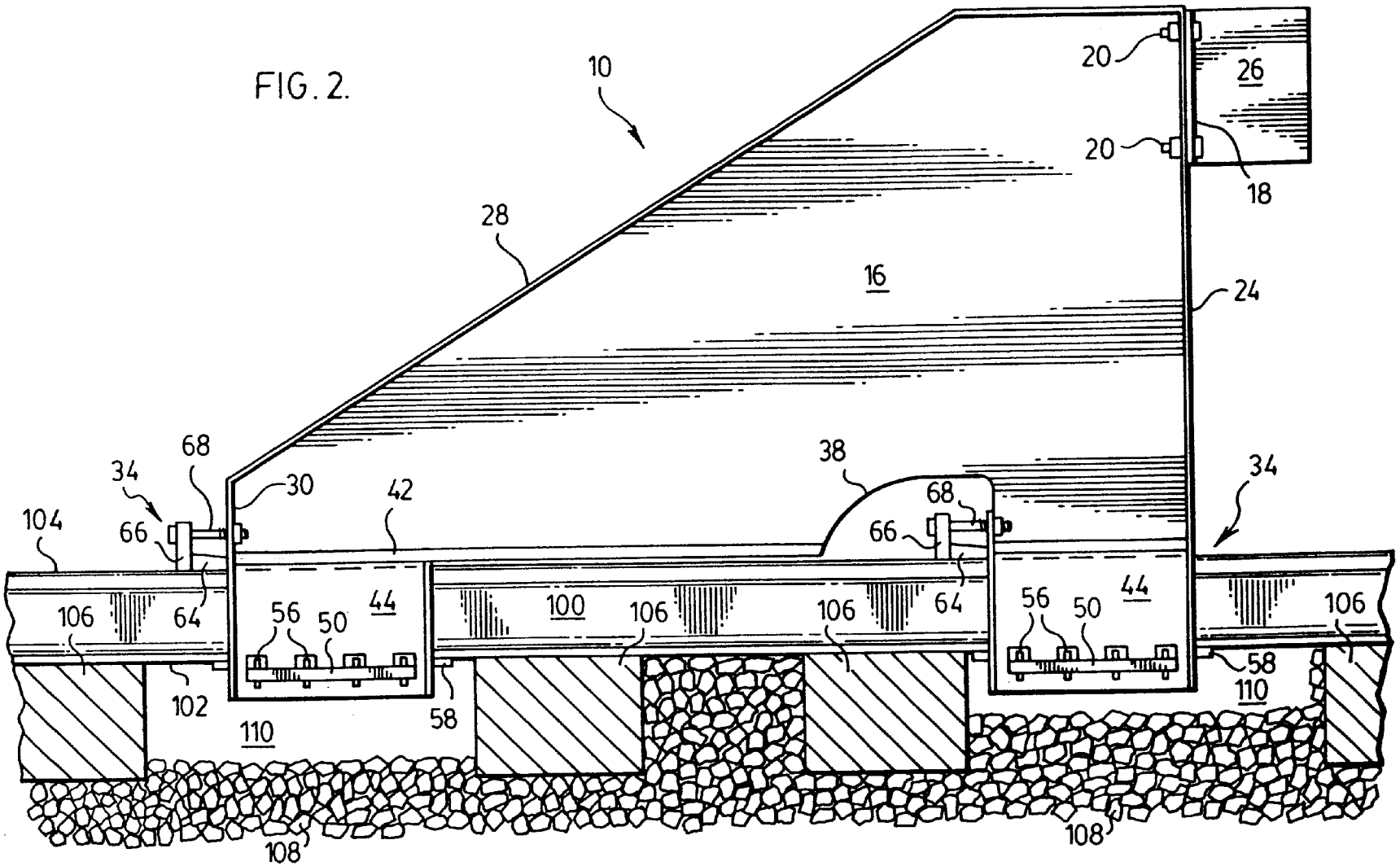
FIG. 2 is a side view of the bumping post of FIG. 1 mounted on a railroad track.
Figure 3:
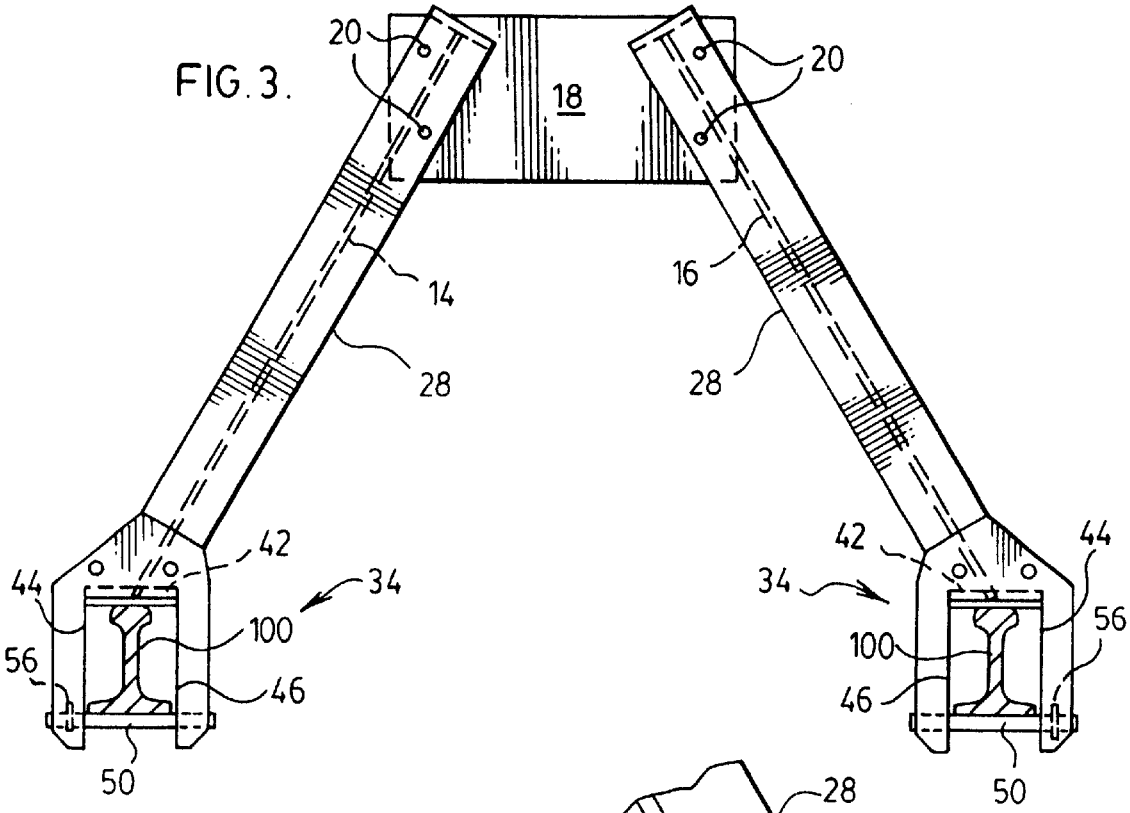
FIG. 3 is a rear end elevational view of the bumping post of FIG. 2.

As best seen in FIGS. 2 and 6, two clamping bolts 68 are provided to retain the wedge member 62 in a preferred clamping position and, in this regard, the bolts 68 extend through openings 70 in the vertical support portion 66 of the wedge 62 and are adapted to be secured to a section of a flange 30 at the rear end of the coupling mechanism 34. In preferred use, the wedge 62 may be driven into a wedged position as with a sledgehammer and, subsequently, the bolts 68 may be tightened.

The wedge member 62 preferably extends into each channelway from the rear of the channelway 47, that is, from a rear end of the channelway 47 opposite to a front end of the frame to which forces are to normally be applied to the bumping post via a bumper head 26. Normal forces acting on the bumping post will therefore tend to increase the extent to which the wedge member 62 is wedged into the channelway 47.

In the preferred embodiment shown, the frame is formed preferably from sheet metal as by welding. Each side wall member 14 and 16 are formed with a central plate of metal with reinforcement flanges welded about their perimeter edges and illustrated as front flanges 22, top flanges 24, rear angled flanges 28, rear vertical flanges 30 and bottom flanges 40. A portion of the bottom flange 40 preferably forms the top plate 42 of each of the front and rear coupling mechanisms 34.

As seen in FIGS. 1 and 2, the side members 16 and 14 have an access opening 38 cut upwardly thereinto to permit a space for insertion and removal of the two wedge members 62 into the forwardmost of the two coupling mechanisms.

The flanges 30 and 22 may be seen to provide increased strength to each of the U-shaped feet formed by the top plate 42 and the two side plates 44 and 46 of each coupling mechanisms 34 by extending downwardly to the lower extent of each of the side plates 44 and 46.

The front wall member 18 preferably carries a bumper head 26 which may be metal or comprise a relatively rigid elastomeric material adapted to engage with a coupling provided at one end of a railway vehicle when the railway vehicle hits the bumping post 10. The bumper head 26 is thus located at a position for engagement by a railway vehicle.

The bumper post in accordance with the present invention is adapted for ease of installation onto a pair of rails.

The bumper post 10 with the bottom plate 50, shims 60 and, optionally, the wedge 62, removed can be lifted as by a crane to be set down upon the rails. Each of the U-shaped channel-forming members formed by the top plate 42 and the side plates 44 and 46 effectively form foot members which are adapted to engage on the rails. In this regard, as seen in FIG. 2, the rails 100 typically rest upon spaced transverse tie members 106 to which the rails 100 are secured in a known manner. Typically, aggregate materials, such as gravel 108, supports the ties 104 and substantially fills the spaces between the ties underneath the rails.

The coupling mechanisms 34 are spaced a distance from each other such that each will fit in a space between adjacent tie members 106. Before setting the bumping posts 10 on the rails, it is preferred that the gravel 106 be removed between the ties where the coupling members are to engage the rails.

This is schematically shown in FIG. 2 in which gravel 108 is shown to have been removed so as to provide working spaces indicated 110 underneath the rails between the ties and, while not shown, to extend laterally at least to some extent either side of the rail 100 so as to permit insertion of a bottom plate 50 and its pin 56.

The bumping post 10 can be placed to sit on the rails, that is, with the upper surfaces 104 of the rails 100 to engage the top plate 42 (or the wedge member 62, if present) and, in this regard, the coupling mechanisms 34 with at least the bottom plate 50 and shims 58 removed effectively form supporting feet which assist installation by permitting the unit to be lowered down and to rest in a secured position supported on the rails 100. Subsequently, workmen may insert the bottom plates 50 pinning them in place with the pins 56, of course, adding any shims 52 as may deemed to be necessary. Subsequently, each of the wedge members 62 may be wedged and secured in place. It is to be appreciated that installation of the bumping post 10 can take place very quickly and by unskilled labour. Similarly, bumping posts in accordance with the present invention can relatively easily be removed and to the extent there may be mechanical failure of the bumping posts, it is not expected that the bottom plate with pins 56 would be damaged so as to prevent their relatively easy removal.

A bumping post in accordance with the present invention has the advantage that when subjected to excessive forces, rather than being bolted to the rails as is the case with some known coupling bumping posts, it is possible that some energy may be dissipated by movement of the coupling mechanisms in sliding longitudinally along the rails.

The preferred bumping post shown in the drawings adopts as a construction for its frame, the relatively simple flanged plates of the side wall members 14 and 16. It is to be appreciated that the frame for the bumping post may have almost any configuration and that coupling mechanisms as illustrated may be adapted for securing many different types of bumping post frame structures, as well as other structures, to rails.

While the bumping post member has been shown as having four clamping mechanisms 34, that is, two for each side of the main frame 12, it is to be appreciated other numbers of coupling mechanisms 34 may be utilized.

Figure 8:
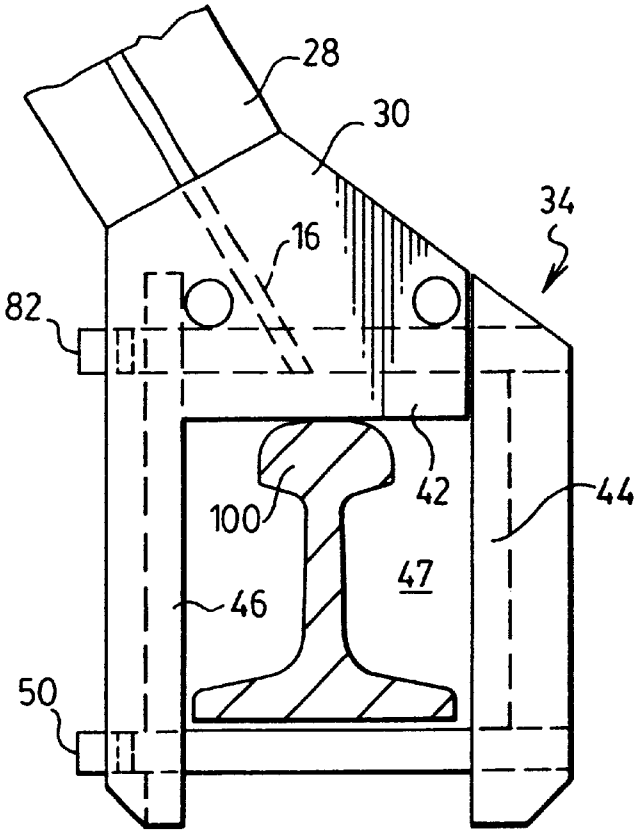
FIG. 8 is a view similar to that of FIG. 7, however, of the coupling assembly in accordance with the second embodiment in an assembled configuration.
Figure 7:
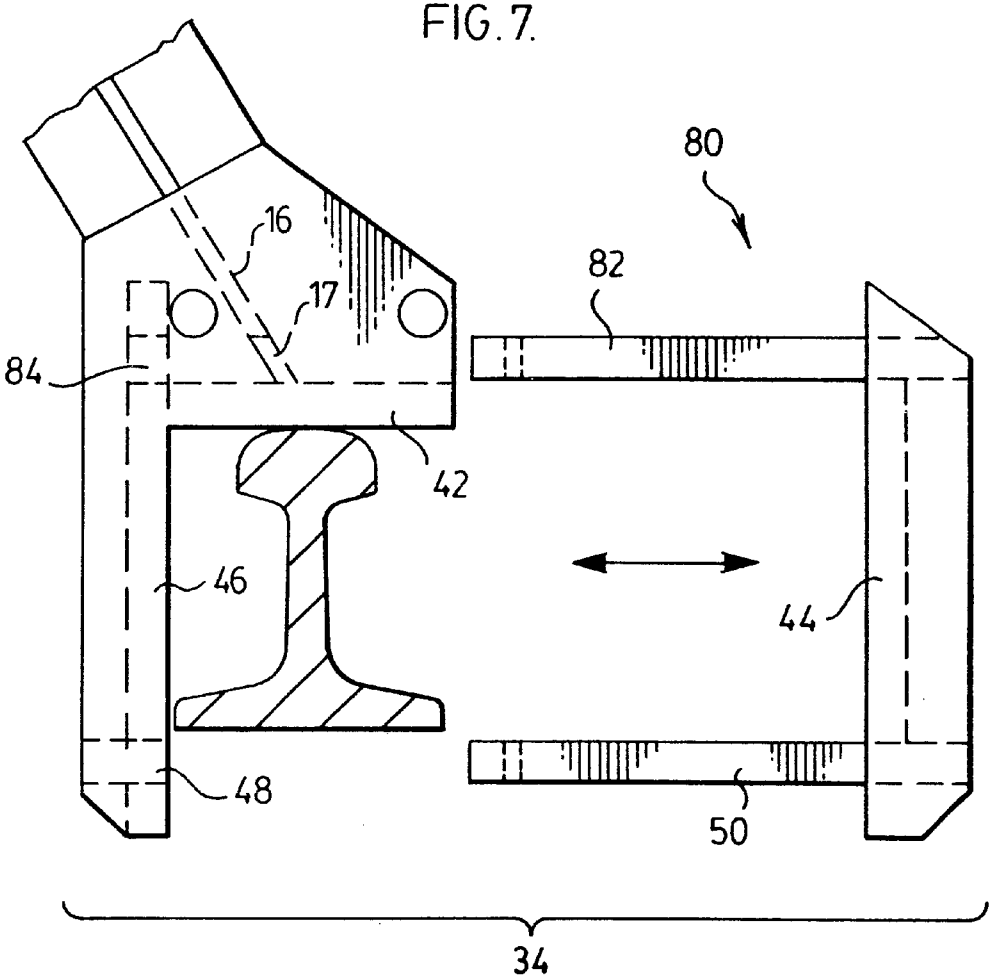
FIG. 7 is an enlarged rear view similar to that shown in FIG. 4 but of a right hand coupling assembly in accordance with a second embodiment of the present invention in an unassembled configuration.

Reference is made to FIGS. 7 and 8 which show a second embodiment of a coupling mechanism 34 in accordance with the present invention. In FIGS. 7 and 8, similar reference numerals are used to refer to similar elements found in the first embodiment.

The coupling mechanism 34 shown in the second embodiment of FIGS. 7 and 8 operate functionally in a similar manner to that with the first embodiment, however, rather than having merely the bottom plate 50 laterally slidable, a removable unit generally indicated 80 incorporates the bottom plate 50 and the right hand side plate 44 welded together as a unitary element and, as well, including a supplemental top plate generally indicated 82. The supplemental top plate 82 preferably has a configuration identical to that of bottom plate 50. The left hand side plate 86 not only has an array of openings 48 therethrough to receive the fingers of bottom plate 50, but also extends upwardly above the top plate 42 to provide another array of openings 84 therethrough disposed above the top plate so as to receive fingers of the supplemental top plate 82. Similarly, the central plate of the side wall member 16 will have openings therethrough to permit passage of the supplemental top plate 82. As may be seen in FIG. 7, the removable unit 80 may slide laterally for engagement such that the supplemental top plate 82 slides above the top plate 42 with its fingers to extend through the plurality of openings 84 in the side plate 46 at the same time as the fingers of the bottom plate 50 slide through the openings 48. The distal ends of the fingers of each of the bottom plate 50 and the supplemental top plate 82 can be pinned to the left hand side of the left hand side plate 44 as in the same manner with the first embodiment. As shown in FIG. 8, when assembled, an enclosed channelway 47 is formed about the rail 100 and, subsequently, a wedge member and/or any shim members (not shown) may be utilized to wedge the coupling mechanism 34 onto the rail.

In the embodiment of FIGS. 7 and 8, as with the first embodiment, on initally placing the bumping post unit onto the rails, the top plate 42 bears the weight of the bumping post and the inner side walls 46 on the right and left side locate the bumping post unit side to side to prevent it from moving side to side. It is to be appreciated that in accordance with the present invention the feet which are formed by the coupling mechanisms 34 before the bottom plate 50 is attached provide for support of the bumping post unit 10 on the rail 100 and preferably a mechanism for lateral orientation and stability thereof so that the bumping post will not become disengaged with the rails as could be dangerous during manual installation of the lower plate 50.

While the invention has been described with reference to the preferred embodiments, many modifications and variations will now occur to a person skilled in the art. For a definition of the invention, reference is made to the following claims.

I claim:

1. A bumping post assembly for securing to rails of a railroad track, the assembly having a frame supporting a bumper member positioned for engagement by a railroad vehicle on the rails, a box-forming coupling foot for coupling the frame to a railroad rail, the foot comprising a top member and two laterally spaced side members, the side members extending downwardly from the top member to define a channelway under the top member and between the side members opening downwardly and adapted to receive a rail under the top member with one side member on each side of the rail and each side member extending downwardly beyond the rail, a removable bottom member extending under the rail from one side member to the other side member and coupled to each of the side members to limit relative movement of the bottom member downwardly away from the top member, the bottom member removably coupled to the side members for removal by movement in a generally horizontal direction, a wedge member for wedging insertion between the top member and a rail received thereunder to wedge the rail vertically between the top member and the bottom member when the bottom member extends under the rail between the side members to enclose the channelway.

2. A bumping post assembly as claimed in claim 1 in which each side member comprises a side plate extending vertically down from the top member along the side of a rail, each side plate having openings extending horizontally therethrough directed towards the other side plate, the bottom member being slidable through the openings in one side plate into the openings in the other side plate to bridge the channelway between the side plates.

3. A bumping post assembly as claimed in claim 2 wherein each side plate has a plurality of said openings disposed in a horizontal row, the bottom member having a comb-like structure with a plurality of individual fingers adapted to slide through the plurality of openings of the side plates, the fingers of the bottom plate joined along a spline portion of the bottom plate.

4. A bumping post assembly as claimed in claim 3 in which each finger has at a distal end remote from the spline portion a removable pin member adapted to be coupled to the distal end of the finger to lock the bottom member in a position in which it bridges the channelway and against sliding relative the side plates.

5. A bumping post assembly as claimed in claim 1 in which the wedge member is adapted for insertion between the top member and a rail received in the channelway and the wedge member is slidable longitudinally intermediate the side members in a direction parallel a longitudinal of a rail to be received therein.

6. A bumping post assembly as claimed in claim 5 wherein the wedge member occupies a space between the top member and the rail of increasing vertical height as the wedge member is moved inwardly into the coupling foot.

7. A bumping post apparatus as claimed in claim 6 including removable threaded locking means to lock the wedge member in a wedging position between the top member and the rail against removal.

8. A bumping post assembly as claimed in claim 1 further including a shim plate adapted to be carried on an upper surface of the bottom member intermediate the bottom member and a rail to be received in the channelway.

9. A bumping post assembly as claimed in claim 8 in which the shim member engages the side members or the bottom member against removal when the bottom member bridges the channelway.

10. A bumping post assembly as claimed in claim 1 including a plurality of said coupling feet with at least one said coupling foot engaging each rail of a railway track, the coupling foot adapted to be vertically lowered downwardly on top of a pair of rails of a railroad track with each rail disposed within the channelway engaging the top member and intermediate the two side members in position for the bottom member for each coupling foot to be slid horizontally under the rail transversely to the rail to couple the two laterally spaced side members and thereby encircle the rail with the top member, side members and bottom member forming a box-like member.

* * * * *